United States Patent [19]

Keller

[11] Patent Number: 4,927,327

[45] Date of Patent: May 22, 1990

[54] CONTACTLESS CENTRIFUGAL SEAL DEVICE FOR A ROTATING MACHINE PART

[75] Inventor: Jakob Keller, Dottikon, Switzerland

[73] Assignee: BBC Brown Boveri AG, Baden, Switzerland

[21] Appl. No.: 283,281

[22] Filed: Dec. 12, 1988

Related U.S. Application Data

[63] Continuation of Ser. No. 84,022, Aug. 11, 1987, abandoned.

[30] Foreign Application Priority Data

Aug. 16, 1986 [DE] Fed. Rep. of Germany ..... 3627778

[51] Int. Cl.[5] ..... F01D 5/14; F04D 29/08; F16J 15/40

[52] U.S. Cl. ..... 415/171.1; 277/3; 277/25; 415/172.1; 415/173.6

[58] Field of Search ..... 277/25, 67, 68, 3, 53; 415/170 A, 110, 172.1, 173.6, 171.1

[56] References Cited

U.S. PATENT DOCUMENTS

| | | | |
|---|---|---|---|
| 633,732 | 9/1899 | Price | 415/171.1 X |
| 2,349,731 | 5/1944 | Hornschuch | 415/171.1 X |
| 2,604,852 | 7/1952 | Baker | 415/170 A X |
| 2,827,261 | 3/1958 | Parker et al. | 415/172 X |
| 2,971,468 | 2/1961 | McDaniel | 415/172 R |
| 3,279,378 | 10/1966 | Sproule | 415/110 X |
| 3,285,501 | 11/1966 | McDonald . | |
| 3,614,256 | 10/1971 | Sieghartner | 415/170 A X |
| 3,680,976 | 8/1972 | Buse | 415/110 |
| 3,976,165 | 8/1976 | Pilarczyk | 415/110 X |
| 4,049,361 | 9/1977 | Chacour | 415/170 A |
| 4,076,450 | 2/1978 | Ross | 415/170 A X |
| 4,209,282 | 6/1980 | Eberhardt | 415/170 A X |
| 4,286,919 | 9/1981 | Yamaguchi | 415/170 A X |
| 4,459,802 | 7/1984 | Mowill | 415/177 R X |
| 4,521,151 | 6/1985 | Frater et al. | 415/171.1 |
| 4,664,592 | 5/1987 | Grzina | 415/171.1 |

FOREIGN PATENT DOCUMENTS

| | | | |
|---|---|---|---|
| 3022622 | 9/1933 | Fed. Rep. of Germany . | |
| 7618495 | 2/1977 | Fed. Rep. of Germany . | |
| 3311121 | 1/1986 | Fed. Rep. of Germany . | |
| 641286 | 6/1962 | Italy | 415/174 |

OTHER PUBLICATIONS

*Machine Design*, Jan. 30, 1964, Wood et al.

*Primary Examiner*—Allan N. Shoap
*Attorney, Agent, or Firm*—Burns, Doane, Swecker & Mathis

[57] ABSTRACT

Instead of labyrinth seals, ordinary circular cylindrical gaps (10, 18) are provided at the positions to be sealed in the contactless centrifugal seal device for, in particular, radial turbo-machines. By means of swirl fins (12) on shrouds (7) of the rotor (2), vortex flows which rotate like solid bodies along with the rotor (2) are induced in the vortex chambers (11), the rotational motion of the particles of the medium in the radial-axial planes being reduced to a thin boundary layer. By this means, the same pressure gradient appears outside the rotor (2) in the vortex chambers (11) between the gaps to be sealed (10, 18) as appears within the rotor (2) over the length of the vane passages (4) so that leakage flows are prevented.

7 Claims, 2 Drawing Sheets

CONTACTLESS CENTRIFUGAL SEAL DEVICE FOR A ROTATING MACHINE PART

This application is a continuation of application Ser. No. 07/084,022, filed Aug. 11, 1987, now abandoned.

BACKGROUND OF THE INVENTION

The present invention relates to a contactless centrifugal seal device for a rotating machine part.

In turbo-machines, labyrinth seals are generally used to prevent, as far as possible, the escape, by throttling in gaps, of the medium to be compressed or expanded from the vane passages into the space formed by the clearance between the compressor or turbine rotor and the casing. There is a lower pressure in this space than there is in the vane passages and this is the cause of the leakage losses.

The effectiveness of the labyrinth seals, which are intended to keep these leakage losses as small as possible, depends mainly on the radial and axial gap widths between the labyrinth crests and the labyrinth chambers and on their number. These gap widths cannot, however, be made arbitrarily small (as they could under static conditions) but have to be dimensioned to take account of the thermal expansion difference between the shaft, rotor and seal crests, on the one hand, and the casing and seal chambers, on the other, and also of the largest deflections to be expected in operation due to the vibrations of the rotating elements. It follows that leakage losses of greater or smaller magnitude are unavoidable in the case of labyrinth seals.

In addition, labyrinth seals demand a structural expenditure which is not unsubstantial. Where the gaps to be sealed have smaller diameters, the seal crests and the groove-shaped seal chambers are generally turned from a solid, with correspondingly expensive machining work. This also applies when, in the case of larger diameters, the crests and chambers are precast and only need to be finish machined to dimensions. A further disadvantage of labyrinth seals consists in the fact that the machining has to be done to very close tolerances and that the installation of the rotor in the casing also requires a high level of precision if the calculated labyrinth clearances are actually to be achieved and rubbing of the crests avoided.

OBJECTS AND SUMMARY

The previously mentioned disadvantages of conventional labyrinth seals are avoided by means of the present invention, which concerns a contactless centrifugal seal device for a rotating machine part. The device has rotation surfaces and is supported so that it can rotate in a casing which has to be sealed against a space at lower pressure, there being narrow annular gaps with diameters of different sizes between the casing and the space mentioned, wherein swirl fins are provided on the rotation surfaces, which swirl fins extend from the annular gaps of smaller diameter to the annular gaps of larger diameter, and wherein a vortex chamber is present in the casing for each rotational surface provided with swirl fins, the swirl fins protruding into this vortex chamber.

The advantages of this centrifugal seal device are particularly apparent in the case of small compressors and turbines because in these, the leakage losses via the labyrinths are a greater percentage proportion of the medium throughput than they are in the larger units. It also has the advantage that gaps do not need to be dimensioned so tightly as in the case of labyrinths so that larger machining tolerances are permitted. In addition, the gaps are ones which are bounded by easily manufactured coaxial circular cylindrical surfaces so that the thermal expansions in the gap region do not have to be calculated with such great accuracy as they do in the case of a labyrinth. It is only necessary to ensure that there is sufficient clearance in the radial direction; the radial gap width is not at all critical and the length of the gap parallel to the axis is completely unimportant. When they heat up, the circular cylindrical gap surfaces mentioned can move freely relative to one another and any danger of rubbing between the surfaces bounding the gaps is excluded.

The invention is explained below in more detail with reference to an embodiment example shown in the drawings.

DETAILED DESCRIPTION

Figure 1:
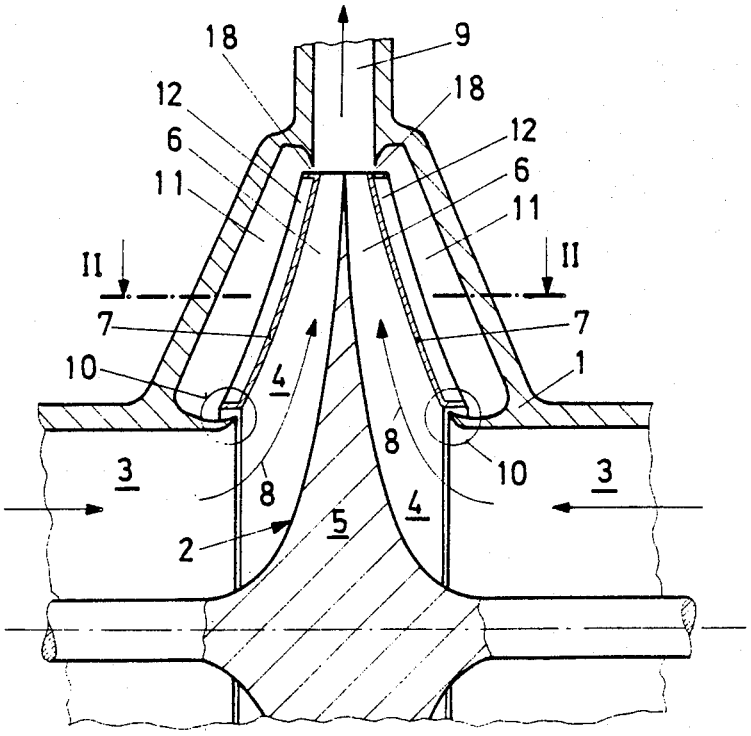
FIG. 1 is a diagrammatical view from an axial section of the rotor of a double-sided centrifugal compressor together with the parts of the casing necessary for understanding the invention.

In the double-sided centrifugal compressor shown in FIG. 1, the compressor casing is indicated by 1 and the double-sided compressor rotor by 2. The medium to be compressed, induced through the two symmetrically located induction ducts 3, passes into the vane passages 4 of the rotor, which are bounded by the hub body 5, the rotor vanes 6 and the shrouds 7. The two partial flows 8 of the medium to be compressed combine, after emerging from the vane passages on the two sides, and leave the compressor via the spiral-shaped outlet duct 9.

In conventional centrifugal compressors, the labyrinth seals are provided where the outer boundary of the induction duct meets the rotor shroud. In the case of the single-sided rotors, which only have one shroud, the second labyrinth seal is located at the outer periphery of the rotor hub on the rear side remote from the vanes. This labyrinth seal prevents leakage into the shaft space of the compressor at this position.

In FIG. 1, the positions provided for the labyrinth seals are indicated by circles 10. Instead of the labyrinths at this location, the invention provides for an annular gap with a radial height at which rubbing between the rotor and the casing cannot occur under any circumstances. The length of the gap parallel to the axis is then unimportant.

Figure 2:
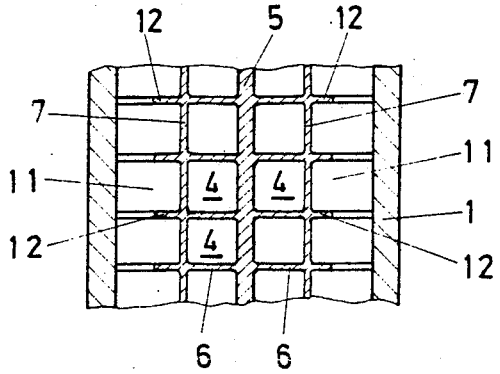
FIG. 2 is a cylindrical section along the section line II—II drawn in FIG. 1, and FIGS. 2 and 4 are diagrammatic views illustrating the mechanism on which the invention is based.

Further physical features of the seal device are vortex chambers 11 and swirl fins 12, which extend into the particular vortex chamber 11 in a meridian section of the rotor 2 and, approximately, over the length of the shroud 7. They are preferably evenly distributed over the shroud 7 and their number and orientation can, as shown in FIG. 2, agree with the number and direction of the rotor vanes 6. As a variation on this, however, they can also, for example, be provided as an elongation of every second rotor vane only or between each two adjacent rotor vanes.

The mode of operation of such a seal device is based on a transmission of swirl by the swirl fins 12 of the rotor to the medium in the vortex chamber 11. The further explanation follows with reference to FIGS. 3 and 4. In both figures, 13 indicates an except of a shroud in the form of a sector of an annulus. These shrouds 13 correspond to the shroud 7 of FIG. 1. The swirl fins 15 and 16 protruding into the vortex chambers 14 correspond to the swirl fins 12 mentioned above. It may be seen that the fins 16 are wider than the fins 15. Apart from the rotational speed, the properties of the medium and the dimensions of the vortex chamber, the widths b of the swirl fins determine the transmission of swirl to the medium.

Figure 3:
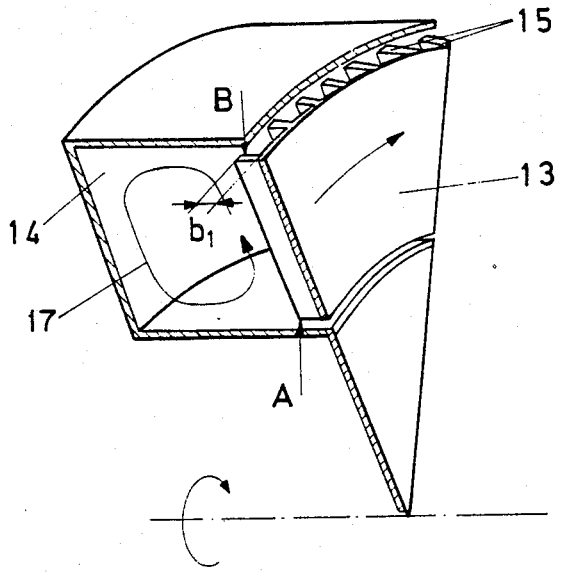

In the case of a weak supply of swirl, for example by means of short swirl fin widths $b_1$, in accordance with FIG. 3, a rotor connected to the shroud 13 induces in the vortex chamber a secondary flow in the form of a vortex flow 17 near the wall in radial-axial planes. Up to an upper limiting value of the width $b_1$, the major proportion of the medium in the vortex chamber remains almost stationary, i.e., this major proportion rotates in the peripheral direction at a substantially lower angular velocity than the shroud 13.

In the case where the fin lengths $b_2$ are larger than the upper limiting value of $b_1$, a swirl is provided to the medium in the vortex chamber which is so strong that the boundary layer dissipation on the walls of the vortex chamber is no longer capable of destroying the swirl generated. As soon as this occurs, the flow field in the vortex chamber changes completely. The particles of the medium are stabilised by this strong swirl on peripheral paths, i.e. orbitally. The major proportion of the medium in the vortex chamber then moves like a body which is solid with the rotor in the aximuthal direction and the radial-axial rotation movement of particles of the medium with markedly smaller peripheral velocity is restricted to a thin boundary layer of thickness d.

Figure 4:
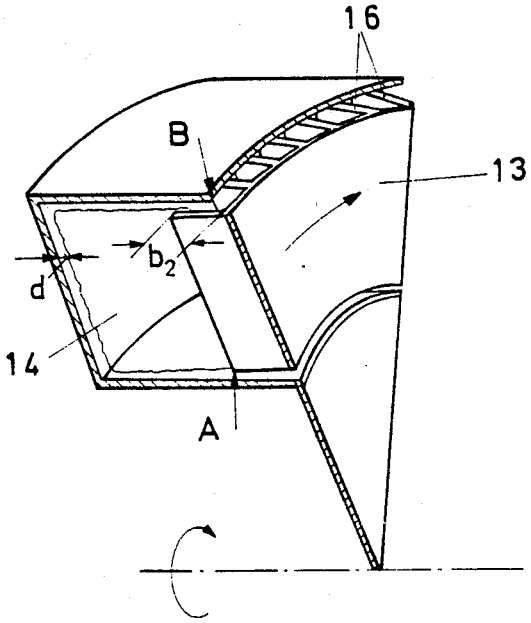

The difference between the two cases consists in the fact that under the conditions of FIG. 3, the static pressure at the positions A and B is almost the same whereas, in the case shown in FIG. 4, the full static pressure difference corresponding to the radial pressure gradient of the rotational movement of the rotor appears between the positions A and B.

In the case of sufficient widths $b_2$ of the swirl fins 12 or 16, the latter can drive, in the vortex chamber, a vortex which rotates like a solid body with the rotor. From this, it follows that the radial pressure rise in the vane passages 4 of the compressor rotor of FIG. 1 is not larger than the radial pressure rise in the vortex chamber 11 of FIG. 1 or in the vortex chamber 14 of FIG. 4. A leakage flow through the gaps at the positions A and B of FIG. 4 (and correspondingly at the positions 10 of FIG. 1, where labyrinth seals are generally provided, and at the gaps 18 between the outer periphery of the shrouds 7 of the compressor rotor 2 and the compressor casing 1) is therefore almost completely prevented. In addition, the boundary layer losses in the vortex chamber reach a minimum in this case.

In practice, the width $b_2$ of the swirl fins necessary to achieve this condition is determined in tests by measuring the pressures in the vortex chamber at the positions 10 and 18, rotors with fins of different widths being investigated at the operating rotational speed. In order to keep the windage losses as small as possible, the smallest possible width $b_2$ of the swirl fins 12, which still gives the vortex flow with the favorable pressure gradients described, is determined.

Although only preferred embodiments are specifically illustrated and described herein, it will be appreciated that many modifications and variations of the present invention are possible in light of the above teachings and within the purview of the appended claims without departing from the spirit and intended scope of the invention.

I claim:

1. A contactless centrifugal seal device for a rotating machine part in a gaseous compressor, which part has an interior space for guiding a gas to be compressed, said part being supported so that it can rotate within a casing such that a low pressure vortex space exists between the casing and the rotating part, said rotating part further including an external rotation surface for separating the interior space from the low pressure vortex space, narrow annular gaps exist between the rotating machine part and the casing at opposite ends of the vortex space, the vortex space between the ends having a width that is a measure of the shortest distance between said external rotation surface along any point thereon between said ends and a surface of said casing opposing the respective point on said external rotation surface, said annular gaps interconnecting the low pressure vortex space and the interior space of the rotating machine part, one of said annular gaps having a first diameter and a second of said annular gaps having a second diameter larger than the diameter of the one annular gap, the seal device comprising:

fin means provided on the external rotation surface from the one annular gap to the second annular gap and extending into the low pressure vortex space for creating a vortex in the low pressure vortex space that is sufficient to create a pressure rise in the low pressure vortex space that is substantially equal to a pressure rise in the interior space during operation of the compressor, said fin means extending into the low pressure vortex space for a distance that is less than half of the width of the low pressure vortex space.

2. The contactless centrifugal seal device of claim 1, wherein the rotating part is a double-sided compressor rotor and includes two rotation surfaces, a hub body, and rotor vanes interconnecting the hub body and the rotation surfaces to define vane passages.

3. The contactless centrifugal seal device of claim 2, wherein the swirl fin means have a rectangular cross-section and are evenly distributed over the periphery of the rotation surfaces.

4. The contactless centrifugal seal device of claim 3, wherein the swirl fin means extend in radial-axial planes from the one annular gap to the second annular gap.

5. The contactless centrifugal seal device of claim 4, wherein the low pressure vortex space is in the shape of a truncated cone and the inner surfaces of the casing that forms the vortex space are parallel to the rotation surfaces of the compressor rotor.

6. The contactless centrifugal seal device of claim 1, wherein the swirl fin means are of a sufficient width so as to move a majority of the medium in the vortex space with the rotor in the azimuthal direction.

7. The contactless centrifugal seal device of claim 1, wherein the swirl fin means extend into the vortex space a distance sufficient to create a pressure difference in the vortex space between the two annular gaps that corresponds to a pressure gradient over the distance of the rotating machine part between the two annular gaps.

* * * * *